United States Patent [19]

Weiler

[11] Patent Number: 4,488,760

[45] Date of Patent: Dec. 18, 1984

[54] METHOD OF MANUFACTURING A BUSHING TOOL

[75] Inventor: Karl M. Weiler, Buck Hill Falls, Pa.

[73] Assignee: Weiler Brush Company, Inc., Cresco, Pa.

[21] Appl. No.: 459,289

[22] Filed: Jan. 20, 1983

[51] Int. Cl.[3] ..... A46B 3/00; A46B 7/08

[52] U.S. Cl. ..... 300/21; 15/181; 15/198

[58] Field of Search ..... 15/179, 180, 181, 182, 15/183, 198, 200; 29/125; 300/21

[56] References Cited

U.S. PATENT DOCUMENTS 553,402 1/1896 Goulding et al. ..... 15/181

2,290,575 7/1942 Potter ..... 15/181

2,534,891 12/1950 Wilhide ..... 15/181

2,534,892 12/1950 Wilhide ..... 15/181

*Primary Examiner*—Peter Feldman

*Attorney, Agent, or Firm*—Seidel, Gonda & Goldhammer

[57] ABSTRACT

A brushing tool for metal working has a circular disc perforated adjacent the rim with a plurality of holes through which wire bundles are passed and then twisted to form radially-extending knots. A plurality of notches are provided in the rim adjacent the holes to provide support for the knots and to limit pivotal movement of the knots in the plane of the disc during use without the need for side plates.

2 Claims, 6 Drawing Figures

METHOD OF MANUFACTURING A BUSHING TOOL

BACKGROUND OF THE INVENTION

This invention relates to a method of manufacturing wire brush tools for metal working operations.

It is an object of the invention to provide a brushing tool which offers performance superior to the performance of prior art brushes while at the same time greatly extending the service life of the brush.

SUMMARY OF THE INVENTION

The instant invention is a brushing tool comprising a circular disc having a plurality of notches in the rim of the disc at approximately uniformly spaced locations. In one embodiment of the invention, the disc has a plurality of circumferentially-disposed perforations adjacent the rim, the perforations being located between the notches and the center of the disc, with each perforation being adjacent to and in radial alignment with a notch. Wire knots extend through and are anchored in each perforation and are supported by the notch adjacent to and in alignment with the perforation, whereby the side walls of the notch limit pivotal movement of the knots in the plane of the disc. The invention also includes means for coupling the brushing tool to a drive means for imparting rotary motion to the disc. In a second embodiment of the invention, the perforations are adjacent to and in offset relation with respect to two consecutive notches. Wire knots extend through and are anchored in each perforation and are supported by the rim of the disc between the two adjacent notches, whereby the rim of the disc limits pivotal movement of the knots in the plane of the disc.

DETAILED DESCRIPTION OF THE INVENTION

Figure 1:
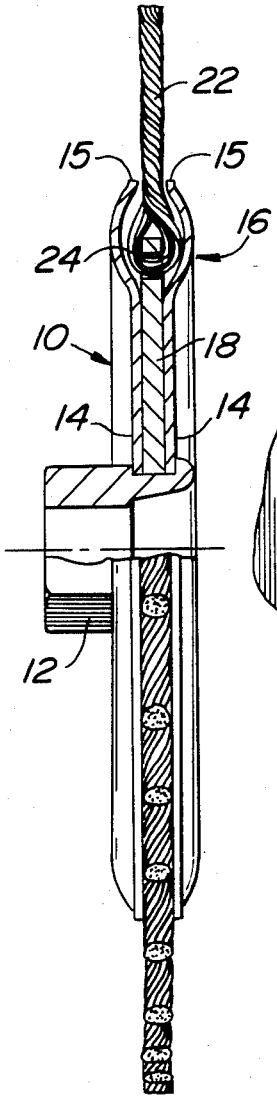
FIG. 1 PRIOR ART
FIG. 1 is a side view illustrating a prior art brush tool, with a portion of the brush shown in cross-section.
Figure 2:
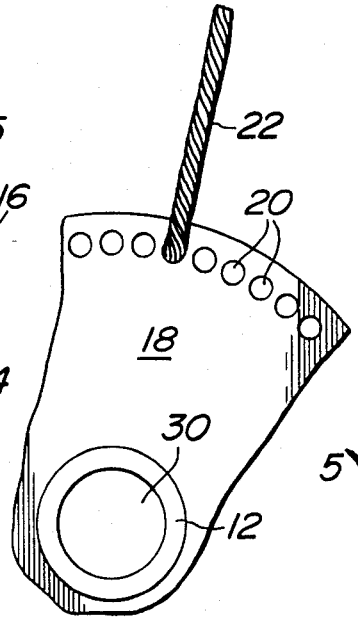
FIG. 2 PRIOR ART
FIG. 2 is a segment of the disc of the prior art brush illustrating the attachment of the brush knots.

Referring to the drawings, wherein like numerals indicate like elements, there is shown in FIGS. 1 and 2 a prior art brush tool 10. The prior art brush 10 has a disc 18 which has a plurality of circumferentially-disposed perforations 20 adjacent the rim of disc 18. Wire bundles are passed through perforations 20 and are then looped and twisted to form radially-extending knots 22. By looping and twisting the wire bundles in this manner, an eye 24 is formed which anchors knots 22 in the disc 18.

Disc 18 is sandwiched between side plates 14. Side plates 14 are formed near the rim to define a bulbous cavity 16 to surround eye 24 and hold knots 22 in place. The extreme ends 15 of side plates 14 are tightly crimped against knots 22 in order to restrict pivotal movement of knots 22 in the plane of disc 18. Side plates 14 and 16 and disc 18 are welded together. A mounting nut 12 for mounting brush 10 to a drive shaft or other means of imparting rotary motion to the brush is provided.

A problem with the prior art brush is that the tight crimp at ends 15 of side plates 14 causes rapid fatigue of the brush knots at that point, contributing to early fatigue failure of the knots. Thus, in normal use, the object being brushed exerts a force against knots 22 which is tangent to disc 18. This force causes knots 22 to pivot in the plane of the plate in a direction opposite to the direction of brush rotation If the crimp at ends 15 is made too tight, knots 22 will bend around a very sharp radius. This sharp bending causes rapid fatigue of the knots and consequent rapid fatigue failure. If, on the other hand, the crimp is made too loose in an attempt to avoid the fatigue problem, knots 22 will pivot to such a degree that the brush loses much of its stiffness and effectiveness as a brushing tool.

Figure 3:
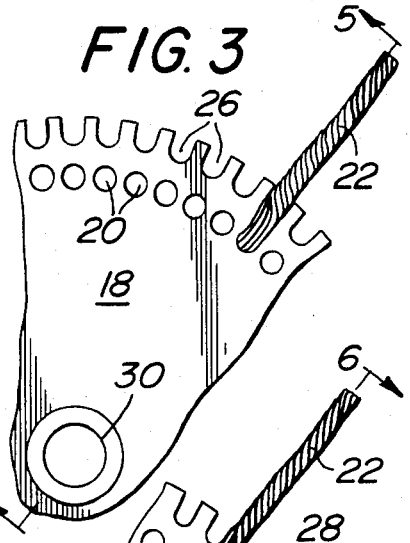
FIG. 3 is a segment of a disc according to one embodiment of the present invention.
Figure 4:
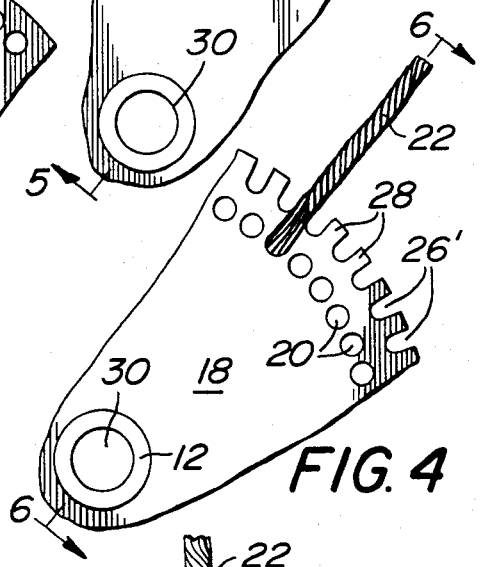
FIG. 4 is a segment of a disc according to a second embodiment of the present invention.

The instant invention overcomes the problems with the prior art brush and, in addition, eliminates the need for side plates 14. Referring now to FIGS. 3–6, the present invention has a disc 18 with a plurality of notches 26 which are cut or otherwise provided in the rim thereof. Perforations 20 are circumferentially disposed and are located between notches 26 and the center of disc 18. Notches 26 may be in radial alignment with perforations 20, as shown in FIG. 3, or they may be in offset relation, as shown in FIG. 4, where the rim portions 28 between two adjacent notches are in radial alignment with perforations 20. The exact shape and dimensions of notches 26 is not believed to be critical to the proper operation of the brush of the present invention, except that the dimension across the open end of notches 26 should be greater than the diameter of knots 22. Preferably, the dimension across the open end of notches 26 is only slightly greater than the diameter of knots 22.

Figure 5:
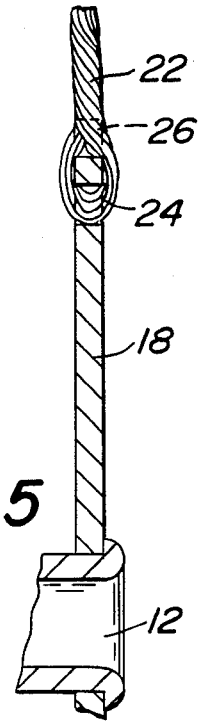
FIG. 5 is sectional view of the disc of the first embodiment taken along the line 5—5 of FIG. 3.

In the first embodiment, wire bundles are passed through perforations 20 and then looped and twisted to form an eye 24. As shown in FIGS. 3 and 5, eye 24 passes through hole 20 and is partially seated within notch 26, inside the circumference of the rim of disc 18, instead of being seated on the circumference of the rim of disc 18 as in the prior art brush. In this first embodiment, knot 22 is supported by the side walls of the notch 26 in which it is seated. When in use, the side walls of notch 26 support knot 22 against tangential forces and limit pivotal movement of knot 22 in the plane of disc 18. Thus, side plates to crimp and hold knots 22 against pivotal movement are no longer required. Moreover, although some pivotal movement of knots 22 will be experienced in normal use, the knots 22 will effectively bend around a larger radius than those of the prior art brush, thereby reducing fatigue and increasing service life of the brush.

Figure 6:
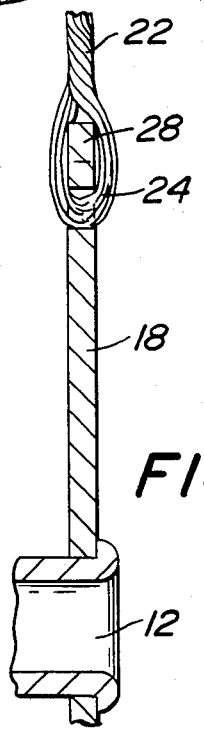
FIG. 6 is a sectional view of the disc of the second embodiment of the invention taken along the line 6—6 of FIG. 4.

In the second embodiment, shown in FIGS. 4 and 6, the notches 26 are offset with respect to perforations 20. Wire bundles are passed through perforations 20 and looped and twisted to form an eye 24. In this embodiment, the wire knots 22 are twisted around rim portions 28 of disc 18 which are located between adjacent notches 26'. The knots 22 are supported by rim portions 28 and are held against pivotal movement in the plane of disc 18 by friction between knots 22 and rim portions 28. In this embodiment also, side plates 14 are no longer required to crimp and hold knots 22 against pivotal movement.

In both embodiments, a central coupling nut 12 is provided to couple the brush to a drive shaft or other means of imparting rotary motion to the brush.

It has been found that the first embodiment offers somewhat more support to knots 22 than the second embodiment. However, both embodiments offer sufficient support to knots 22 so that side plates 14 are not required for either embodiment.

The present invention may be embodied in other specific forms without departing from the spirit or essential attributes thereof and, acordingly, reference should be made to the appended claims, rather than to the foregoing specification, as indicating the scope of the invention.

I claim:

1. A method of manufacturing a brushing tool, comprising the steps of:

(a) perforating a circular disc with a plurality of circumferentially disposed holes adjacent the rim thereof, (b) providing a plurality of notches in the rim of the disc at approximately uniformly-spaced locations so that each notch is adjacent and in radial alignment with a hole, (c) passing wire bundles through each perforation and twisting the bundles to form an eye so as to anchor the bundles in each perforation, (d) partially seating the eye in the notch adjacent and in alignment with the perforation, and (e) providing means for coupling the disc to drive means for imparting rotary motion to the plate.

2. A method of manufacturing a brushing tool, comprising the steps of:

(a) perforating a circular disc with a plurality of circumferentially-disposed holes adjacent the rim thereof, (b) providing a plurality of notches in the rim of the disc at approximately uniformly-spaced locations so that the notches are adjacent and in offset relation to two consecutive holes, (c) passing wire bundles through each perforation and twisting the bundles to form an eye so as to anchor the bundles in each perforation, (d) supporting the eye on the rim of the disc between two consecutive notches so that the bundles are free-standing without being supported by side plates, and (e) providing means for coupling the disc to drive means for imparting rotary motion to the disc.

* * * * *